US005359347A

United States Patent [19]

Kim et al.

[11] Patent Number: 5,359,347

[45] Date of Patent: Oct. 25, 1994

[54] CURSOR PROCESSOR

[75] Inventors: Hong-seok Kim; Hyeong-bok Lee, both of Kyunggi, Rep. of Korea

[73] Assignee: Samsung Electronics Co., Ltd., Kyunggi, Rep. of Korea

[21] Appl. No.: 906,469

[22] Filed: Jun. 30, 1992

[30] Foreign Application Priority Data

Dec. 4, 1991 [KR] Rep. of Korea ..... 91-22165

[51] Int. Cl.[5] ..... G09G 3/02

[52] U.S. Cl. ..... 345/145; 345/157

[58] Field of Search ..... 340/709, 721, 723, 734; 345/161, 162, 157, 156, 145

[56] References Cited

U.S. PATENT DOCUMENTS 3,911,419 10/1975 Bates et al. ..... 340/709

4,245,244 1/1981 Lijewski ..... 340/709

*Primary Examiner*—Richard Hjerpe

*Assistant Examiner*—Minsun Oh

*Attorney, Agent, or Firm*—Leydig, Voit & Mayer

[57] ABSTRACT

A cursor processor for use in a video adapter includes a location designator for processing a cursor signal to be displayed with a video signal, a reference location value generator for generating location information by sections of a screen, a location control signal generator for generating X- and Y-axes active section signals to set a cursor display location according to the location designation information and location information by sections. A cursor data generator is provided for generating cursor data according to the Y-axis active section signal and a cursor data array is provided for arranging the cursor data in a set location on the screen according to the X- and Y-axes active section signals. A data inserter is included for inserting the arranged processing speed of a cursor signal.

9 Claims, 7 Drawing Sheets

503
504
505

502
506
501
500

CURSOR PROCESSOR

BACKGROUND OF THE INVENTION

The present invention relates to a video adapter for a digital information processing system, and more particularly to a processor for displaying a cursor on a display.

Generally, digital information processing systems which include computers, word processors, CADs, and CAMs, process information in digital form. This digital information is processed by a video adapter in video signal form to be displayed on a video display. In addition to this function, such a video adapter processes a cursor for displaying the state of user-input information. The video adapter generally uses software to perform the processing of the cursor.

In the cursor processing method using software, cursor data is processed according to cursor position information designated by a digital information processing system, and is stored along with video data into a memory where the video data is stored. Here, the stored cursor data is logically added to the video data to make its background screen clear. The logically added cursor data is exclusive-OR'ed with video data near the cursor's edge to make its value distinct.

However, in the cursor processing method using software, its processing speed decreases because, as the resolution of the display heightens, steps to be processed increase relatively. Additional auxiliary programs are also required. Especially, when a mouse is used as an input means for the digital information processing system, the cursor processing speed of the video adapter is noticeably decreased, and many auxiliary programs for use in cursor processing are required.

SUMMARY OF THE INVENTION

It is an object of the present invention to provide a cursor processor capable of enhancing its cursor processing speed by use of hardware.

It is another object of the present invention to provide a cursor processor capable of adaptively and precisely controlling a cursor displaying location according to the display resolution.

It is still another object of the present invention to provide a video adapter capable of enhancing its cursor processing speed and reducing the amount of required programs.

To accomplish the objects, there is provided a cursor processor comprising: a reference location designation generator for receiving external location data and cursor display control and write control signals to generate reference location data and cursor display driving data for designating a location where a cursor is displayed; a pixel location data generator for generating location data of a currently-displayed pixel; a location control signal generator for generating location active section signals of X and Y axes to set a cursor display region according to the reference location data and pixel location data; a cursor data generator for generating cursor data according to the Y-axis location active section signal; a cursor data array for re-arranging cursor data into cursor shape data and cursor pattern data according to the value of X-axis reference location data generated from the reference location designation generator; and a data mixer for mixing the re-arranged cursor data with video data.

BRIEF DESCRIPTION OF THE DRAWINGS

The above objects and other advantages of the present invention will become more apparent by describing in detail a preferred embodiment of the present invention with reference to the attached drawings in which.

DETAILED DESCRIPTION OF THE INVENTION

Prior to a detailed description of the present invention, a cursor processing method using hardware will be described below.

Usually, displaying a cursor on a screen requires at least cursor data (its pattern and shape) and information as to its location on the screen. The cursor data is stored in advance in a cursor data memory by a processor and the location information (X and Y addresses) is used for a cursor circuit by the processor. The above process takes place when the cursor is not displayed (between frames), so real-time processing is not affected. In processing the location information, the location information provided by a processor is a reference to determine the display location of the cursor, and is compared with a display address produced by counting a blanking signal and a video clock pulse to determine the cursor-active region. After establishing the cursor-active region, each line of cursor data corresponding to the cursor-active region is read out from a cursor data memory immediately prior to its being displayed, the cursor data being composed of pattern data and shape data. Since such data is formed by words and output data transmitted to a monitor interface is also formed by words, cursor location by pixels cannot be displayed, and then the data must be reconstructed as word data corresponding to the pixel location information. The process is accomplished by shifting data as much as the value of certain bits of the X address included in the location information. This pre-processing enables real-time processing and the processing of data by words or in larger groups, and reduces the frequency of the synchronizing clock used for a hardware cursor processor. Video data is logically added to the pattern data, and is XOR'ed with the shape data, which is carried out in the cursor-active region by words.

Now, the present invention will be described below in connection with the hardware cursor processing method, with reference to the attached drawings.

Figure 1:
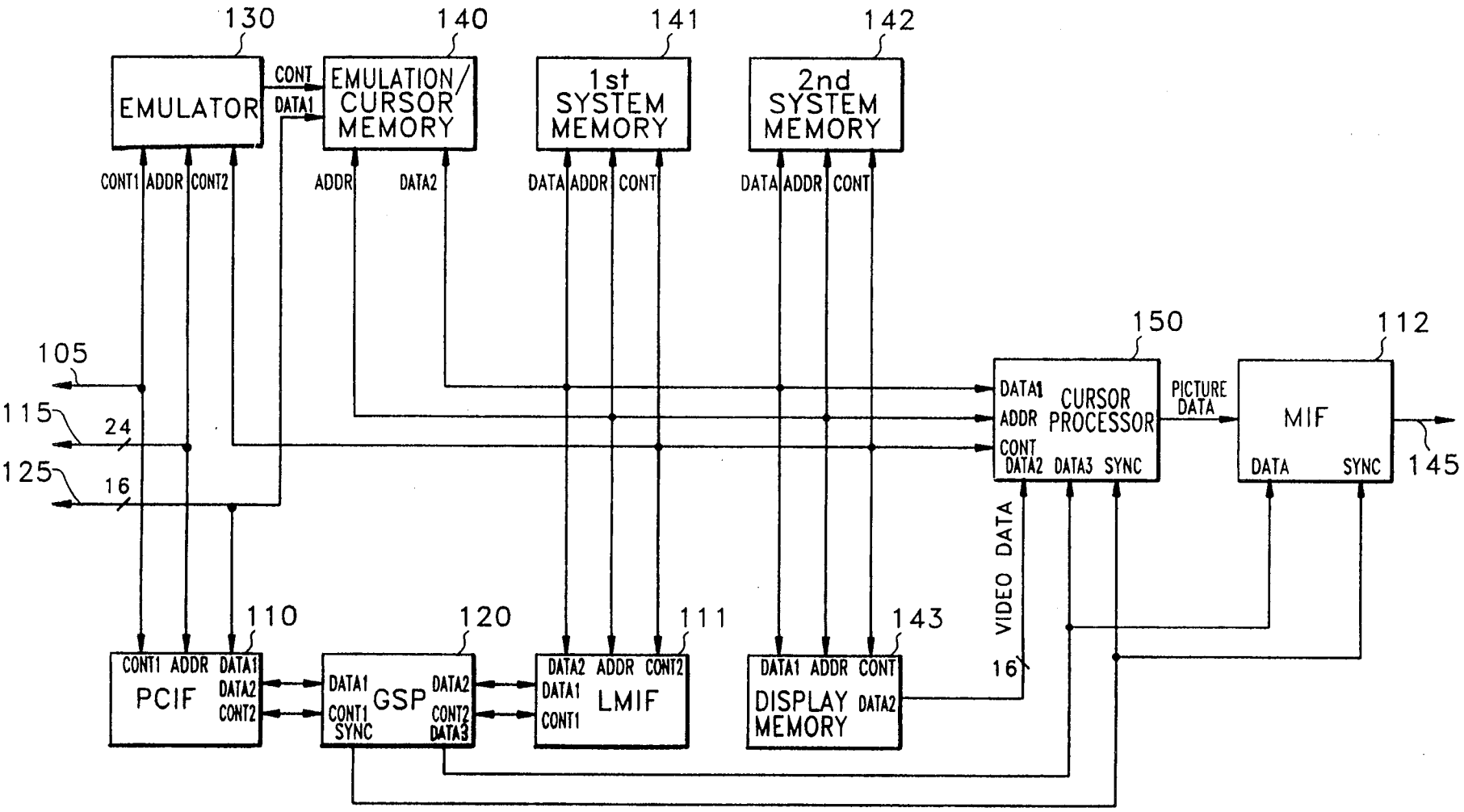
FIG. 1 is a block diagram of a video adapter to which the cursor processor of the present invention is applied.

In FIG. 1, reference numerals 105, 115 and 125 represent first, second and third input/output (I/O) ports, 145 is an output port, 110 is a personal computer interface (PCIF), 111 is a local memory interface (LMIF), 112 is a monitor interface (MIF), 120 is a graphic system processor (GSP), 130 is an emulator, 140 is an emulation/cursor memory, 141 and 142 are first and second system memories, 143 is a display memory, and 150 is a cursor processor.

The first, second and third I/O ports are connected to a personal computer (not shown). First I/O port 105 is connected to first control ports of emulator 130 and PCIF 110, while second I/O port 115 is connected to address ports thereof. Third I/O port 125 is connected to first data ports of emulation/cursor memory 140 and PCIF 110. A second data port of PCIF 110 is connected to a first data port of GSP 120. A second control port of PCIF 110 is connected to a first control port of GSP 120. A second control port of GSP 120 is connected to a first control port of LMIF 111. A synchronizing signal port of GSP 120 is connected to synchronizing signal ports of cursor processor 150 and MIF 112, and serves as a clock signal source. A second data port of GSP 120 is connected to a first data port of LMIF 111, while its third data port is connected to data ports of cursor processor 150 and MIF 112. A second control port of LMIF 111 is connected to a second control port of emulator 130 and to control ports of first system memory 141, second system memory 142, display memory 143 and cursor processor 150. An address port of LMIF 111 is connected to address ports of emulation/cursor memory 140, first system memory 141, second system memory 142, display memory 143 and cursor processor 150. A second data port of LMIF 111 is connected to a second data port of emulation/cursor memory 140, data ports of first and second system memories 141 and 142, and to first data ports of display memory 143 and cursor processor 150. A second data port of display memory 143 is connected to a second data port of cursor processor 150. An output of cursor processor 150 is connected to the picture data input of MIF 112. The output of MIF 112 is connected to a display (not shown) via output port 145. Also, a control port of emulation/cursor memory 140 is connected to emulator 130.

In the operation of FIG. 1, PCIF 110 receives a control signal, a 24-bit address signal (SA0–SA16 and LA1-7–LA23) and a 16-bit data signal (SD0–SD15) which are fed from first, second and third I/O ports 105, 115 and 125 which are connected to a personal computer. The control signal and data signal are transmitted to GSP 120. Control and data signals from GSP 120 are transmitted back to the personal computer via first and third I/O ports 105 and 125.

Emulator 130 uses the control signals input via first input 105 and from LMIF 111 to control the access of emulation/cursor memory 140. Here, when the control signal is input to emulator 130 via first I/O port 105, emulation/cursor memory 140 stores emulation data input to its first data port via third I/O port 125. When the control signal is applied from LMIF 111 to emulator 130, emulation/cursor memory 140 reads the stored emulation data, and reads the data stored in a storage area corresponding to the logic value of a 14-bit address signal (ADD0–ADD13) applied from LMIF 111, sending the result back to LMIF 111. Emulator 130 is driven by the 24-bit address signal (SAO–SA16 and LA1-7–LA23) input via second I/O port 115. When the control signals from first I/O port 105 and LMIF 111 are input simultaneously, one of the two above-mentioned operations is carried out first, according to their priority.

GSP 120 controls the data stored in emulation/cursor memory 140 by a video display designating instruction applied from the personal computer via PCIF 110. Detailed control operations of the cursor data are as follows. GSP 120 reads out the cursor data stored in emulation/cursor memory 140 via LMIF 111, and stores the read data in display memory 143. Cursor processor 150 controls display memory 143 so that cursor data stored therein is supplied to its second data port and synchronized using synchronizing signals.

To display the cursor, GSP 120 supplies a cursor display control signal and the cursor's location data to the first data port of cursor processor 150 via LMIF 111. GSP 120 also generates a vertical synchronizing signal, a horizontal synchronizing signal and a blanking signal to supply them to the third data port of cursor processor 150 and data port of MIF 112.

First system memory 141 temporarily stores the data produced when GSP 120 operates and is composed of a dynamic random access memory (DRAM) having a capacity of about 2 MB. First system memory 141 contains various forms of cursor data processed in GSP 120, while emulation/cursor memory 140 stores only current cursor data.

Second system memory 142 stores an operation program of GSP 120 as well as various parameters, and is composed of a read only memory (ROM) having a capacity of about 32 KB.

Emulation/cursor memory 140 stores emulation data input via third input port 125 and cursor data about information to be displayed. Display memory 143 temporarily stores one frame of video data processed in GSP 120 and is composed of a VRAM having a capacity of about 1.5 MB.

When the cursor's location data and a cursor display control signal are fed from GSP 120 into its first data port and its control port via LMIF 111, cursor processor 150 reads out cursor data stored in emulation/cursor memory 140, and mixes video data input from display memory 143 to its second data port with the read cursor data to generate picture data which is supplied to MIF 112. When cursor data is not mixed with video data, cursor processor 150 transmits untouched video data output from display memory 143 to MIF 112. To perform the above operation, cursor processor 150 responds to a video clock pulse train supplied from MIF 112 and horizontal and vertical synchronizing signals and a blanking signal which are output from GSP 120. MIF 112 includes a clock generator for generating video clock pulse train to supply it to GSP 120 and cursor processor 150. MIF 112 also transmits picture data input from cursor processor 150 to a display (not shown) via output port 145. The picture data from cursor processor 150 is timed with the horizontal and vertical synchronizing signals and the blanking signal which are output from GSP 120, and the video clock pulse train generated from the MIF 112 itself.

Figure 2:
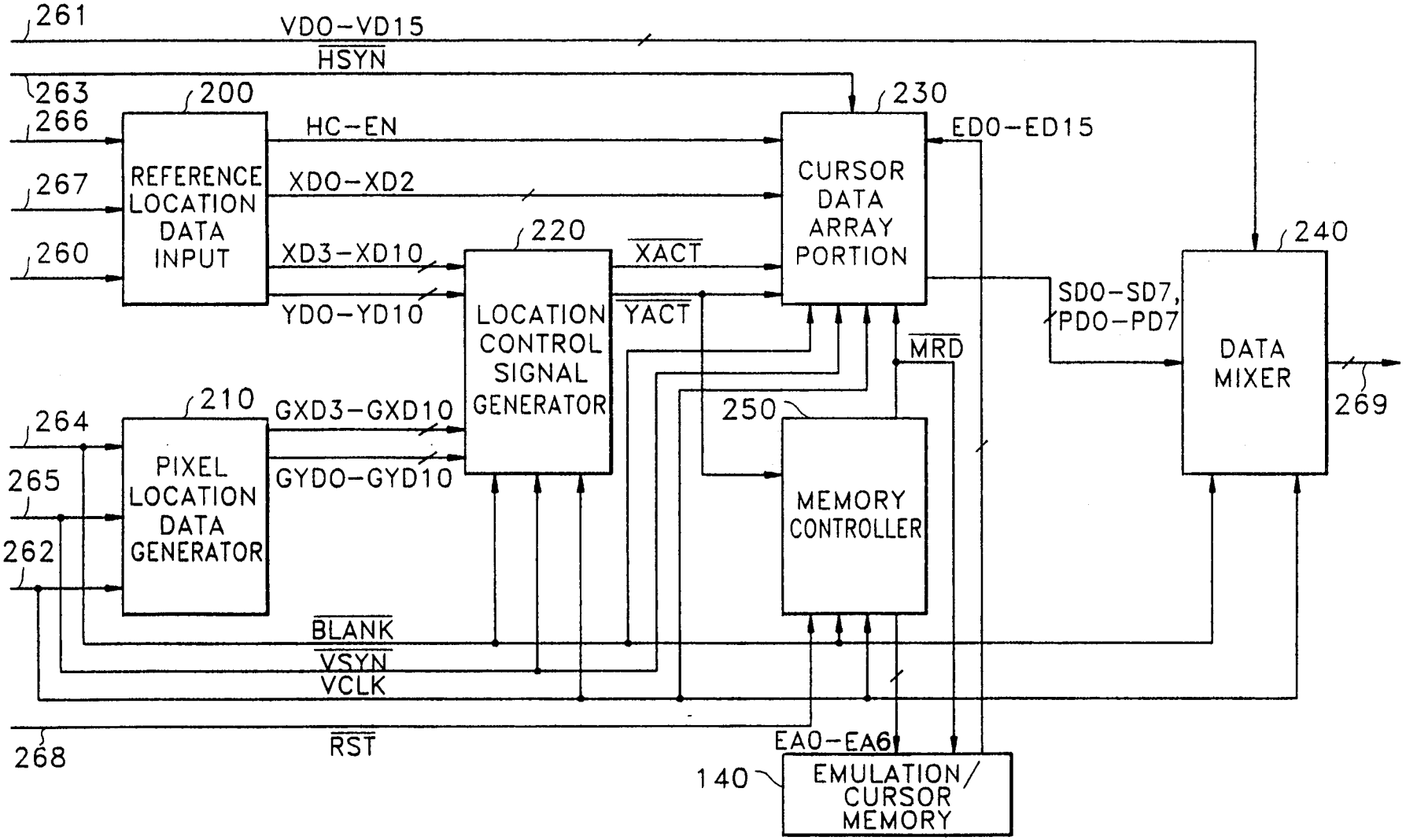
FIG. 2 is a block diagram of a cursor processor of the present invention.

FIG. 2 is a detailed block diagram of cursor processor 150 according to the present invention for the video adapter of FIG. 1.

In FIG. 2, to receive cursor reference location data LAD0–LAD15, a first data port 260 is connected to the second data port of LMIF 111 of FIG. 1, and is also connected to a data input port of a reference location data input portion 200. To receive video data VD0–VD15, a second data port 261 is connected to the second data port of display memory 143 of FIG. 1, and is also connected to a first data port of a data mixer 240. To receive video clock pulse train VCLK, a clock input port 262 is connected to the synchronizing signal port of MIF 112 of FIG. 1, and is also connected to first control ports of a pixel location data generator 210, a cursor data array portion 230, a data mixer 240 and memory controller 250. To receive a horizontal synchronizing signal $\overline{\text{HSYN}}$, a first synchronizing signal input port 263 is connected to the synchronizing signal port of GSP 120 of FIG. 1, and is also connected to a fourth control port of cursor data array portion 230. To receive a blanking signal $\overline{BLANK}$, a second synchronizing signal input port 264 is connected to the synchronizing signal port of GSP 120 of FIG. 1, and is also connected to a second input port of pixel location data generator 210, a first control port of location control signal generator 220, and second control port of cursor data array portion 230, data mixer 240 and memory controller 250. To receive a vertical synchronizing signal $\overline{VSYN}$, a third synchronizing signal input port 265 is connected to the synchronizing signal port of GSP 120 of FIG. 1, and is also connected to a third input port of pixel location data generator 210, a second control port of location control signal generator 220, a third control port of cursor data array portion 230 and a second control port of data mixer 240. To receive a cursor display control signal, a first control signal input port 266 is connected to the second control port of LMIF 111 of FIG. 1, and is also connected to a first control port of reference location data input portion 200. To receive a write control signal $\overline{W}$, a second control signal input port 267 is connected to the second control port of LMIF 111 of FIG. 1, and is also connected to the second control port of reference location data input portion 200. To receive a system reset signal $\overline{RST}$, a third control signal input port. 268 is connected to the second control port of LMIF 111 of FIG. 1, and is also connected to a third control port of memory controller 250.

First and second output ports of reference location data input portion 200 are connected to first and second inputs of location control signal generator 220. Third and fourth outputs of reference location data input portion 200 are connected to eighth and ninth control ports of cursor data array portion 230. First and second outputs of pixel location data generator 210 are connected to third and fourth inputs of location control signal generator 220. A first output of location control signal generator 220 is connected to a fifth control port of cursor data array portion 230. A second output of location control signal generator 220 is connected to a sixth control port of cursor data array portion 230 and a fourth control port of memory controller 250. A first output of memory controller 250 is connected to a control port of cursor data array portion 230 and a second data port of emulation/cursor memory 140. A second output of memory controller 250 is connected to an address port of emulation/cursor memory 140. A data port of emulation/cursor memory 140 is connected to an input of cursor data array portion 230. An output of cursor data array portion 230 is connected to a second input of data mixer 240. The output of data mixer 240 is supplied to the data input of MIF 112 of FIG. 1 via an output port 269.

In the operation of FIG. 2, reference location data input portion 200 receives the cursor's reference location data as X-Y coordinates which are fed to LMIF 111 from GSP 120 and stores the data until new cursor reference location data is input. For this, reference location data input portion 200 divides 16-bit location data (LAD0–LAD15) into 11-bit location data (XD0–XD10) for the X axis, 11-bit location data (YD0–YD10) for the Y axis, and 1-bit cursor display driving data (HC-EN) using the logic values of 14th and 15th location data (LAD13 and LAD14), cursor display control signal $\overline{CSR}$, and write control signal $\overline{W}$, and stores the divided data.

Reference location data input portion 200 supplies separately stored 8-bit X-axis reference location data (XD3–XD10) and 11-bit Y-axis reference location data (YD0–YD10) to the first and second inputs of location control signal generator 220 via its first and second outputs, and supplies 3-bit X-axis reference location data XD0–XD2 and cursor display driving data (HC-EN) to the eighth and ninth control ports of cursor data array portion 230 via its third and fourth outputs.

To provide a reference for determining a cursor active region by obtaining currently-displayed pixel location information, pixel location data generator 210 generates 11-bit Y-axis pixel location data (GYD0–GYD10) and 11-bit X-axis pixel location data (GXD0–GXD10) according to blanking signal $\overline{BLANK}$ and vertical synchronizing signal $\overline{VSYN}$ which are input via second and third synchronizing signal input ports 264 and 265 from GSP 120 and video clock pulse train VCLK input from MIF 112, and supplies 8-bit X-axis pixel location data (GXD3–GXD10) and 11-bit Y-axis pixel location data (GYD0–GYD10) to the third and fourth inputs of location control signal generator 220 via its first and second outputs.

To compare the location information with a current pixel address and determine a cursor-active region, location control signal generator 220 compares reference location data of the X and Y axes (XD3–XD10 and YD0–YD10) input from reference location data input portion 200 with pixel location data of the X and Y axes (GXD3–GXD10 and GYD0–GYD10) input from pixel location data generator 210 so as to confirm the region where the cursor is displayed on the screen. Location control signal generator 220*a* generates Y-axis active section signal $\overline{YACT}$ and X-axis active section signal $\overline{XACT}$ which indicate a cursor display region. These signals are generated according to blanking signal $\overline{BLANK}$ and video clock pulse train $\overline{VCLK}$ so as to supply the signals to the fifth and sixth control ports of data array portion 230 via its first and second outputs. Location control signal generator 220 generates X/Y-axes active section signals according to the logic state of vertical synchronizing signal $\overline{VSYN}$.

Memory controller 250 generates address signal (EA0–EA6) and memory read signal $\overline{MRD}$ according to a low logic Y-axis active section signal $\overline{YACT}$ from location control signal generator 220. Memory controller 250 supplies memory read signal $\overline{MRD}$ to the read port of emulation/cursor memory 140 and the seventh control port of cursor data array portion 230 via its first output, and supplies address signal (EA0–EA6) to the address port of emulation/cursor memory 140 via its second output. Here, memory read signal $\overline{MRD}$ and address signal (EA0–EA6) are generated during a horizontal synchronizing period.

Emulation/cursor memory 140 internally stores cursor data in advance under the control of GSP 120, and reads out the stored cursor data according to memory read signal $\overline{MRD}$ and address signal (EA0–EA6) which are generated from memory controller 250 to supply the 16-bit cursor data (ED0–ED15) to the input of cursor data array portion 230.

Emulation/cursor memory 140 may be installed separately or may be included in first system memory 141 of FIG. 1. In the latter case, the first and second outputs of memory controller 250 and the input of cursor data array portion 230 are connected to the control port, address port and data port of first system memory 141, respectively.

When low logic X/Y-axes active section signals $\overline{XACT}$ and $\overline{YACT}$ are input from location control signal generator 220, cursor data array portion 230 receives cursor data from emulation/cursor memory 140 to send it to the second data input of data mixer 240. Here, the cursor data array portion's cursor data input is performed by a low logic memory read signal $\overline{MRD}$ generated from memory controller 250, and the cursor data array portion's cursor data transmission is performed by video clock pulse train $\overline{VCLK}$. Before sending cursor data (ED0–ED15) from emulation/cursor memory 140 to data mixer 240, cursor data array portion 230 moves (i.e. bit-shifts) the cursor data by the number of pixels corresponding to the logic value of 3-bit X-axis reference location data (XD0–XD2) generated from reference location data input portion 200. Thus, rearranged 16-bit cursor data (SD0–SD7 and PD0–PD7) is supplied to data mixer 240. Cursor data array portion 230 performs the arrangement of cursor data while high logic cursor display driving data bit (HC-EN) is applied from reference location data input 200 to its ninth control port.

Data mixer 240 mixes cursor data (SD0–SD7 and PD0–PD7) from cursor data array portion 230 and video data (VD0–VD15) from display memory 143 of FIG. 1, and supplies the mixed 16-bit video data to the input of MIF 112 of FIG. 1 via output port 269, with the data being timed with video clock pulse train $\overline{VCLK}$.

Data mixer 240 logically adds higher-order 8-bit cursor data (PD0–PD7) which shows the cursor pattern to two pairs of and 8-bit video data (higher-order VD0–VD7 and lower-order VD8–VD15), and exclusive-OR's both pairs of the logically added 8-bit video data with lower-order 8-bit cursor data (SD0–SD7) which defines cursor shape. Data mixer 240 synchronizes the XOR'ed video data to video clock pulse train VCLK and outputs the data. Since cursor data is "0" in a region where cursor data is absent, data mixer 240 outputs untouched video data (VD0–VD15) input via second data input port 261 from display memory 143 to output port 269.

FIG. 3A through 3D are detailed circuit diagrams of cursor processor shown in FIG. 2.

Figure 3A:
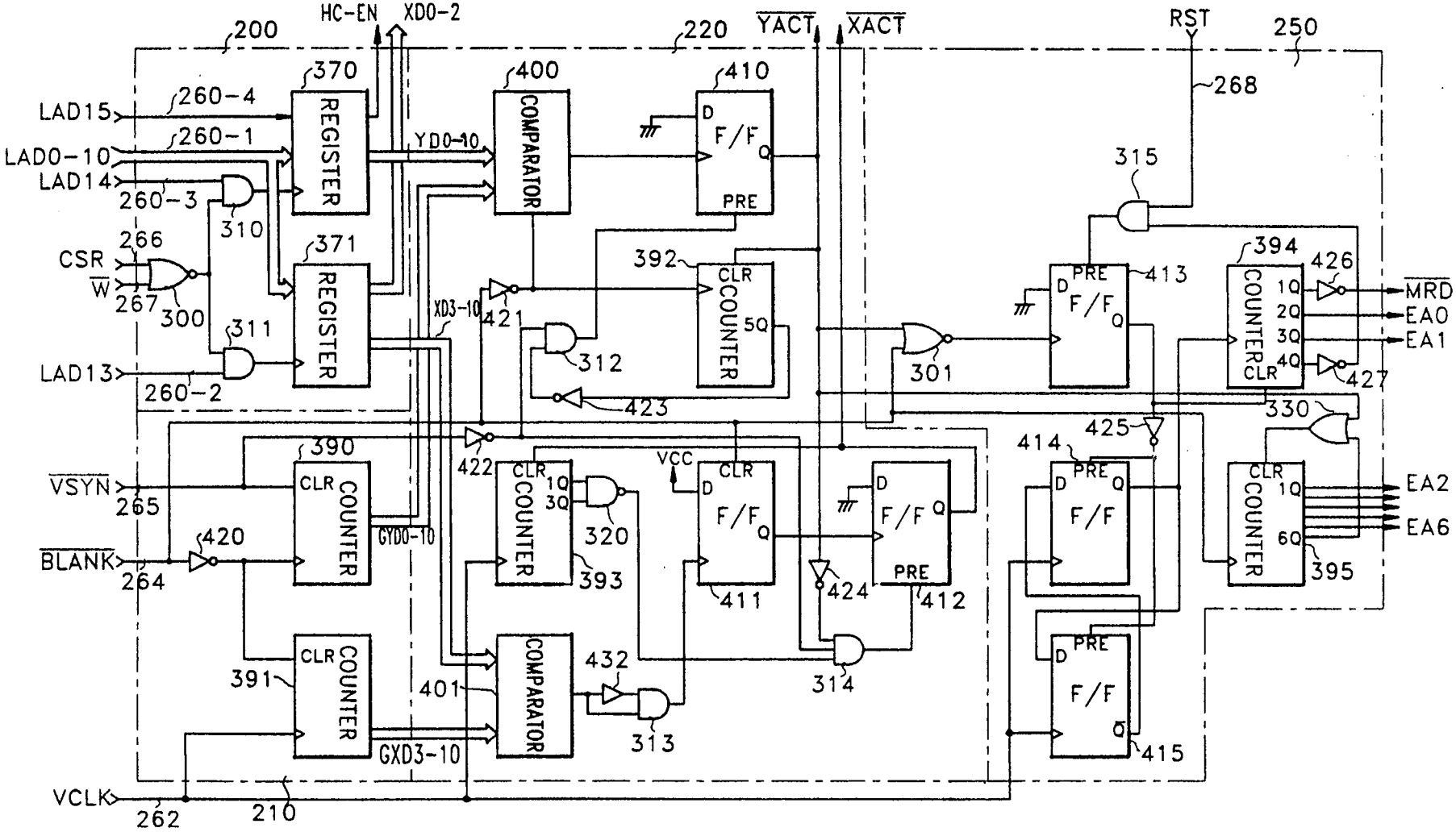
FIGS. 3A through 3D are detailed circuit diagrams of the cursor processor shown in FIG. 2.

In FIG. 3A, reference location data input 200 consists of a negating logical sum device 300, two logical product devices 310 and 311, and two registers 370 and 371. Pixel location data generator 210 is composed of an inverting device 420 and two counters 390 and 391. Location control signal generator 220 consists of two comparators 400 and 401, two counters 392 and 393, three D-flipflops 410, 411, and 412, three logical product devices 312, 313, 314, and four inverting devices 421, 422, 423 and 424, a negating logical product device 320, a buffer device 432 and a negating logical sum device 301. Memory controller 250 consists of three D-flipflops 413, 414 and 415, three inverting devices 425, 426 and 427, two counters 394 and 395, a logical product device 315, and a logical sum device 330.

Figure 3B:
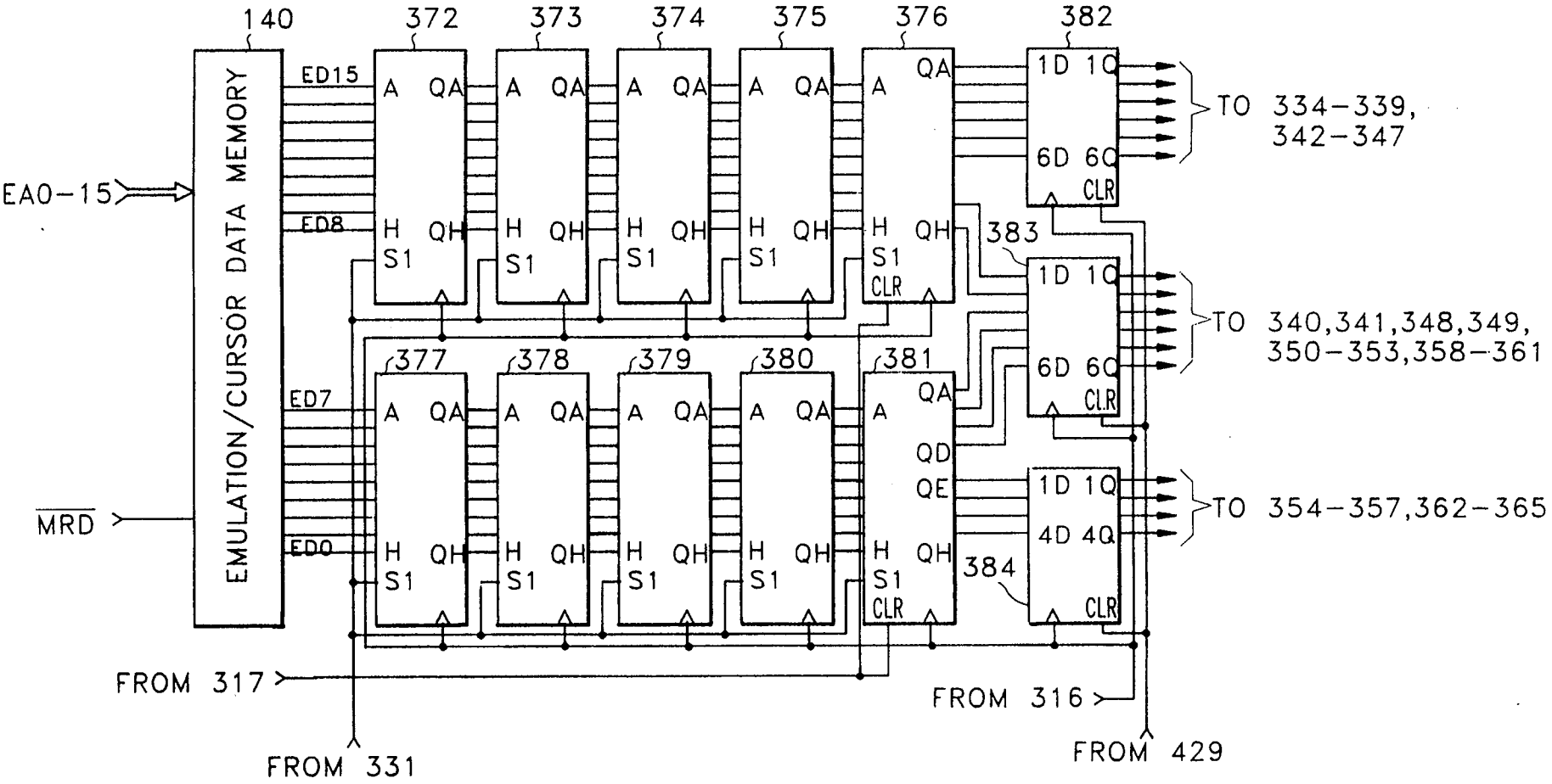
Figure 3C:
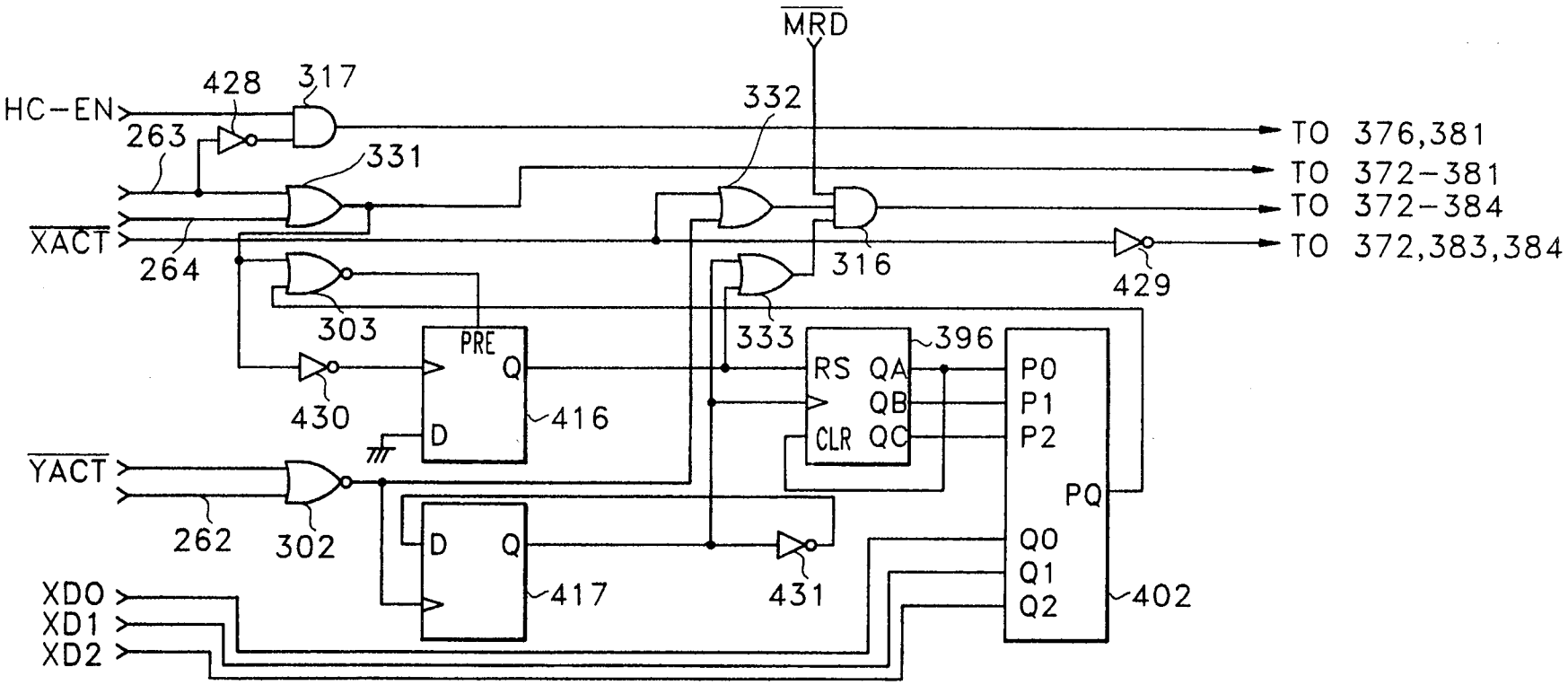
Figure 3D:
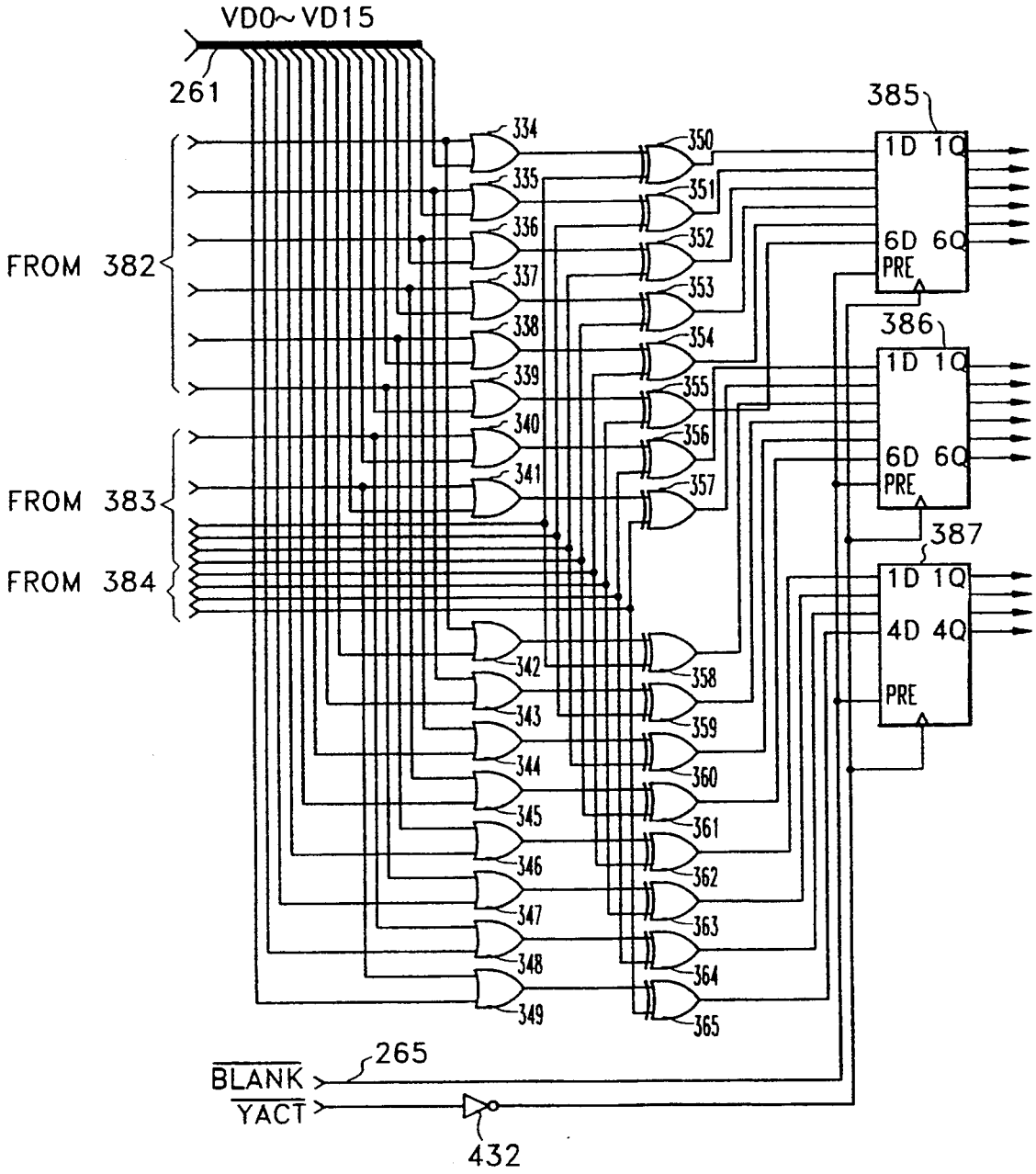

In FIG. 3C, cursor data array portion 230 consists of two logical product devices 316 and 317, two D-flipflops 416 and 417, two negating logical sum devices 302 and 303, three logical sum devices 331, 332 and 333, four inverting devices 428, 429, 430, and 431, thirteen registers 372–384, a counter 396 and a comparator 402. Data mixer 240, depicted in FIG. 30, consists of sixteen logical sum devices 334–349, sixteen XOR devices 350–365, three registers 385, 386 and 387, and an inverting device 432.

Operation of FIGS. 3A and 3B will be described below while referring to the circuits of FIG. 2.

First, referring to FIG. 3A, in reference data input portion 200, negating logical sum device 300 performs a NOR operation with cursor display control signal $\overline{CSR}$ supplied to first control port 266 and write control signal $\overline{W}$ supplied to second control port 267, and when both its inputs are low, generates a high logic signal. Logical product device 310 logically multiplies fifteenth bit location data LAD14 of a first data port 260-3 and the output of negating logical sum device 300, and when both its inputs are high, generates a high logic signal. Logical product device 311 logically multiplies fourteenth bit location data LAD13 of a first data port 260-2 and the output of negating logical sum device 300, and when both its inputs are high, generates a high logic signal.

When a high logic pulse from logical product device 310 is input to the clock port of register 370, register 370 receives lower-order 11-bit and MSB location data (LAD0–LAD10 and LAD15) supplied to first data port 260-1 and 260-4. Register 370 then supplies Y-axis location data (YD0–YD10) to a first input of comparator 400, and supplies the input MSB location data LAD15 to the first input of logical product device 317 of FIG. 3C as cursor display driving data (HC-EN). When a high logic pulse from logical product device 311 is input to the clock port of register 370, it also receives the 11-bit location data (LAD0-LAD10) supplied to first data port 260-1. From this 11-bit location data input, register 371 supplies lower-order 3-bit reference location data (XD0–XD2) to a first input of comparator 402 (FIG. 3C), and supplies higher-order 8-bit reference location data (XD3–XD10) to a first input of comparator 401. Here, negating logical device 300 and logical product devices 310 and 311 function jointly as one decoder.

In pixel location data generator 210, while vertical synchronizing signal $\overline{VSYN}$ applied to the clear port counter 390 via third synchronizing signal input 265 stays low, counter 390 counts up by one whenever blanking signal $\overline{BLANK}$ from second synchronizing signal input port 264 is inverted to logic high state via inverting device 420 and applied to its clock port, so as to generate incremented 11-bit Y-axis pixel location data (GYD0–GYD10). While blanking signal $\overline{BLANK}$ stays low at its clear port, counter 391 counts up by one whenever applied with a video clock pulse (VCLK), so as to generate incremented 8-bit X-axis pixel location data (GXD3–GXD10). Counters 390 and 391 initialize their count values whenever a high vertical synchronizing signal ($\overline{VSYN}$) or a high blanking signal ($\overline{BLANK}$) is input to their respective clear ports.

In location control signal generator 220, comparator 400 compares 11-bit reference location data (YD-0–YD10) from register 370 and 11-bit Y-axis pixel location data (GYD0–GYD10) from counter 390 so as to generate a high logic pulse which indicates the start position of the cursor with respect to the vertical axis. Comparator 400 operates while inverted as blanking signal $\overline{BLANK}$ applied to its enable port via inverting device 421 stays low. When a low logic pulse from comparator 400 is applied to the clock port of D-flipflop 410, D-flipflop 410 inverts a high logic output signal into low logic. When a low logic signal is applied from logical product device 312 to the preset port of D-flipflop 410, generates a pulse of the Y-axis active section signal $\overline{YACT}$ is generated by inverting a low logic output signal into high logic. While Y-axis active section signal $\overline{YACT}$ from the Q output of D-flipflop 410 stays low at the clear port of counter 392, counter 392 counts up by one whenever a high blanking pulse ($\overline{BLANK}$) is applied to its clock port via inverting device 421. Logical product device 312 logically multiplies the output signal from fifth-bit output port 5Q of counter 392 which is applied to one of the input ports of logical product device 312 via inverting device 423, and vertical synchronizing signal $\overline{VSYN}$ applied to its other input port via third synchronizing signal input port 265 and inverting device 422, and when the count value of counter 392 reaches 32, supplies a low logic signal to the preset port of D-flipflop 410. As a result, the width of the low logic pulse of Y-axis active section signal $\overline{YACT}$ equals the period of 32 horizontal synchronizing signals.

Meanwhile, comparator 401 receives higher-order 8-bit X-axis reference location data (XD3–XD10) from register 371 and higher-order 8-bit X-axis reference pixel location data (GXD3–GXD10) from counter 391, and when the two sets of input data are the same, supplies a high logic comparison signal to buffer device 432 and logical product device 313, indicating the cursor's horizontal start position. Logical product device 313 obtains the logical product the output of buffer device 432 which delays the rising edge of the output signal from comparator 401 for as long as the delay time of buffer device 432, and the output of comparator 401. Here, a delay-time dependent, variable comparison signal is supplied to the clock port of D-flipflop 411.

In more detail, when the output of comparator 401 is high, the input to buffer device 432 is delayed while being inverted to a logic low, to be supplied to one input of logical product device 313. Concurrently, the logic high signal output from comparator 401 is fed to the other port of logical product device 313, thus producing a low logic level output. The inverse is true when the output of comparator 401 is low; that is, with a delayed high signal at one port and the undelayed low signal supplied directly to the other port input of logical product device 313, the comparison signal from the comparator is varied according to the time delay of buffer device 432. Buffer device 432 and logical product device 313 function jointly to delay the comparison signal.

When a low logic blanking signal ($\overline{BLANK}$) is applied to the clear port of D-flipflop 411 via second synchronizing signal input port 264, D-flipflop 411 initializes its output signal. When a delayed comparison signal having a high logic pulse is applied from logical product device 313 to its clock port, D-flipflop 411 then inverts its Q output to high logic. When D-flipflop 412 inverts the high logic output signal from D-flipflop 411 to low logic. Further, when a low logic signal is applied from logical product device 314 to its preset port, D-flipflop 412 inverts the low logic output signal to high logic to generate X-axis active section signal $\overline{XACT}$ which stays low for a predetermined period.

With the above low logic X-axis active section signal $\overline{XACT}$ applied to its clear port, counter 393 counts up by one whenever a video clock pulse (VCLK) is applied to its clock port via clock input 262. Negating logical product device 320 performs a NAND operation with the LSB and third-bit outputs signal of counter 393, and when the counter value reaches 5, generates a low logic signal. The three-input logical product device 314 logically multiplies the Y-axis active section signal $\overline{YACT}$ output from the Q port of D-flipflop 410 and inverted via inverting device 424, the vertical synchronizing signal $\overline{VSYN}$ inverted via inverting device 422, and the output of negating logical product device 320, and then applies the resultant logic signal to the preset port of D-flipflop 412.

In memory controller 250, negating logical sum device 301 performs a NOR operation with the blanking signal $\overline{BLANK}$ input via second synchronizing signal input port 264 and the Y-axis active section signal $\overline{YACT}$ from the output of D-flipflop 410 and, when both inputs are low, generates a high logic signal. D-flipflop 413 changes the logic of its Q output to low logic at the rising edge of the signal applied to its clock port from negating logical sum device 301, applies its output to inverting device 425, and changes it to high logic according to the logic product of fourth-bit output 4Q of counter 394 and system reset signal 268 which are applied to its clear port via logical product device 315. When the inverted output signal of D-flipflop 413 which is applied to the preset port of D-flipflop 414 via inverting device 425 stays high, D-flipflop 414 whose data input is connected to the $\overline{Q}$ output of D-flipflop 415 together with D-flipflop 415 whose data input is connected to the Q output of D-flipflop 414, latch according to video clock pulse train VCLK applied to their respective clock ports via clock input 262, which divides the video clock pulse train by two. When the output signal of D-flipflop 413 applied to the clear port of counter 394 stays low, counter 394 counts up the divided video clock pulse train VCLK applied to its clock port from the Q output of D-flipflop 414. The output of LSB output 1Q of counter 394 is used for memory read signal $\overline{MRD}$, the outputs of second and third bit outputs 2Q and 3Q form a two-bit address signal (EA0 and EA1) for emulation/cursor memory 140, and the output of fourth-bit output port 4Q is used to initialize D-flipflop 413. Inverting device 426 inverts the LSB output signal of counter 394 and outputs it. Logical product device 315 logically multiplies system reset signal $\overline{RST}$ input via third control signal input port 268 and the inverted fourth-bit output signal of counter 394 which is input via inverting device 427, and then supplies the result to the preset port of D-flipflop 413.

As a result, during cursor display, D-flipflops 413–415, inverting devices 425–427, logical product device 315 and counter 394 generate four address signals before the beginning of the horizontal scanning period of the line where the cursor is located.

Meanwhile, when low logic Y-axis active section signal $\overline{YACT}$ from D-flipflop 410 is applied to the clear port of counter 395 via logical sum device 330, counter 395 counts up blanking signal $\overline{BLANK}$ applied to its clock port via second synchronizing signal input port 264, and generates a 5-bit address signal (EA2–EA6). Logical sum device 330 logically adds the logic signal of sixth-bit output 6Q of counter 395 to the Y-axis active section signal $\overline{YACT}$, and supplies the result to the clear port of counter 395.

Emulation/cursor memory 140 reads out the internally stored 16-bit cursor data (ED0–ED15) according to memory read signal $\overline{MRD}$ and 7-bit address (EA0–EA6) which are applied from counters 394 and 395, and supplies the read data to the input of registers 372 and 377 of FIG. 3B.

Referring to FIG. 3C which shows cursor data array portion 230 in more detail, negating logical sum device 302 performs a NOR operation with Y-axis active section signal $\overline{YACT}$ from the Q output of D-flipflop 410 and video clock pulse train VCLK input via clock input port 262, and supplies the result to logical sum device 332 and the clock port of D-flipflop 417. Here, the output signal of negating logical sum device 302 is a video clock pulse train (VCLK) whose phase is inverted during the low logic interval of the Y-axis active section signal $\overline{YACT}$. D-flipflop 417 whose Q output is connected to its data input via inverting device 431 divides the output of negating logical sum device 302 input to its clock port by two, and supplies the divided output to the clock port of counter 396 and to logical sum device 333.

Meanwhile, logical sum device 331 logically adds the horizontal synchronizing signal $\overline{HSYN}$ input via first synchronizing signal input port 263 and the blanking signal $\overline{BLANK}$ input via second synchronizing signal input port 264, and supplies the result to first transmission mode select ports S1 of registers 372–381, negating logical sum device 303 and inverting device 430. At the rising edge of the output signal of the inverted logical sum device 331 applied from inverting device 430, D-flipflop 416 changes a high logic signal of its Q output to low logic, and changes a low logic signal to high logic according to a low logic signal applied from negating logical device 303 to its preset port. When the logic signal applied from the Q output of D-flipflop 416 to its reset port stays low, counter 396 generates a 3-bit count value by counting up by one according to the pulse train applied from the Q output of D-flipflop 417 to its clock port via inverting device 431. Comparator 402 compares lower-order 3-bit X-axis reference location data (XD0–XD2) input from register 371 with the 3-bit count value input from counter 396, and when the two inputs are the same, generates a low logic comparison signal. Negating logical sum device 303 performs a NOR operation with the outputs of logical sum device 331 and comparator 402, and when both inputs are low, supplies a high logic signal to the preset port of D-flipflop 416. When the output of negating logical device 303 is high, D-flipflop 416 sets its Q output high. Logical sum device 333 logically adds the outputs of D-flipflops 416 and 417, and supplies the result to logical product device 316. As a result, the output of logical sum device 333 has the number of pulses corresponding to the logic value of lower-order 3-bit X-axis reference location data (XD0–XD2). Logical sum device 332 logically sums X-axis active section signal $\overline{XACT}$ input from the Q output of D-flipflop 412 and the output of negating logical sum device 302, and supplies the result to logical product device 316. Here, logical sum device 332 outputs the pulses only during a period which X-axis active section signal $\overline{XACT}$ designates and during a horizontal scanning period which is designated by Y-axis active section signal $\overline{YACT}$. The output of logical sum device 332 has four pulses.

Logical product device 316 logically multiplies the output of logical sum devices 332 and 333 and memory read signal $\overline{MRD}$ input from LSB output 1Q of counter 394 via inverting device 426, and supplies the result to the clock ports of registers 372–384. The output of logical product device 316 is serially formed of pulses numbering eight or fewer and by which the memory read signal $\overline{MRD}$ re-adjusts the horizontal cursor location, and of four pulses for moving in parallel 32 pixel data by eight. Logical product device 317 logically multiplies the cursor display driving data (HC-EN) input from register 370 and inverted horizontal synchronizing signal $\overline{HSYN}$ input via first synchronizing signal input port 263 and inverting device 428, and supplies the result to the clear ports of registers 376 and 381. Registers 372–376 transmit four higher-order 8-bit cursor data (ED8–ED15) input from emulation/cursor memory 140 to registers 382 and 383. Registers 377–381 transmit four lower-order 8-bit cursor data (ED0–ED7) to registers 383 and 384. Here, the whole 32-bit cursor data input to registers 372–376 contains information about the shape of the cursor, and cursor data input to registers 377–381 contains information about the borders of the cursor. Whenever a pulse is applied from logical product device 316 to the registers' clock ports during the horizontal synchronizing period and horizontal scanning period, each of registers 372–376 and 377–381 transmits cursor data in parallel to a following register according to a logical signal applied from logical sum device 331 to respective transmission mode select ports S1. Whenever a pulse is applied from logical product device 316 to their clock ports during a blanking period, each of registers 372–376 and 377–381 shifts cursor data by one bit and transmits it in series to a following register.

Registers 382, 383 and 384 perform transmission only during X-axis cursor display period according to X-axis active section signal $\overline{XACT}$ applied from D-flipflop 412 to their clear ports via inverting device 429. During the transmission, whenever a pulse is applied from logical product device 316 to the respective clock ports, registers 382–384 transmit re-arranged 16-bit cursor data (PD0–PD7 and SD0–SD7) input from registers 376 and 381, to logical sum devices 334–349 and XOR devices 350–365.

Finally, in data mixer 240, through one input port each, logical sum devices 334–341 receive higher-order 8-bit cursor data (PD0–PD7) output from registers 382 and 383 by one bit, respectively, and through their other input ports, each receives higher-order 8-bit video data (VD8–VD15) out of 16-bit video data input via second data input port 261 by one bit, so as to logically add the two input signals. Through one input port each, logical sum devices 342–349 receive lower-order 8-bit cursor data (SD0–SD7) output from registers 382 and 383 by one bit, respectively, and through their other input ports, each receives the 8-bit video data (VD8–VD15) out of 16-bit video data input via second data input port 261 by one bit, so as to logically add the two input signals. XOR logic sum devices 350–357 XOR-operate the logically added result input from logical sum devices 334–341 which are correspondingly connected to one port of each, and lower-order 8-bit cursor data (SD0–SD7) input from registers 383 and 384 to their other input ports, and supply the result to registers 385 and 386. XOR logical sum devices 358–365 XOR-operate the logically added result input from logical sum devices 342–349 which are correspondingly connected to one port of each, and lower-order 8-bit cursor data (SD0–SD7) input from registers 383 and 384 to their other input ports, and supply the result to registers 386 and 387. Registers 385, 386 and 387 operate only during a horizontal scanning period by blanking signal $\overline{BLANK}$ applied to their preset ports via second synchronizing signal input port 265, and during the operation, whenever a video clock pulse (VCLK) is input to the clock ports of registers 382, 383 and 384 via clock input port 262, transmits the XOR-operated result input from XOR logical sum devices 350–365, in parallel to MIF 112 via output port 269 (FIG. 2).

Figures 4A, 4B, 4C, 4D, 4E:
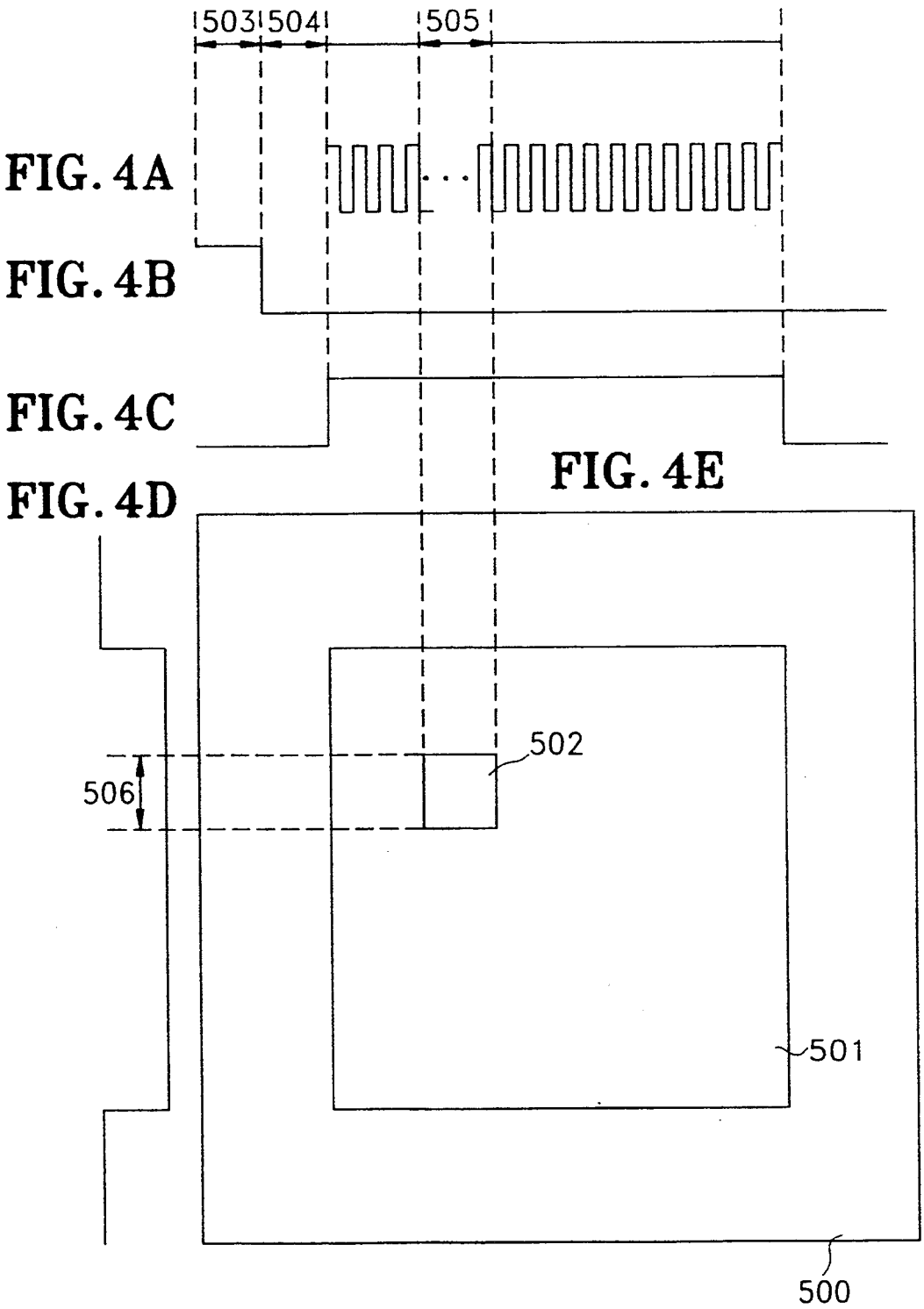
FIGS. 4A to 4E show cursor displaying conditions for the present invention.

In FIGS. 4A to 4E, FIG. 4A shows video clock pulse train VCLK, FIG. 4B shows the horizontal synchronizing signal $\overline{HSYN}$, FIG. 4C shows blanking signal $\overline{BLANK}$,FIG. 4D shows vertical synchronizing signal VSYN, and FIG. 4E shows a monitor screen. In FIG. 4E, reference numeral 500 represents the perimeter of the monitor, 501 is a region with no displayed video data, and 502 is the region where the cursor is displayed. First period 503 is a horizontal synchronizing period where cursor data is input in parallel. In second period 504, cursor data input during a blanking period is shifted by 0 to 7 pixels according to the value of lower-order 3-bit X-axis reference location data (XD0–XD2) so as to precisely re-adjust the horizontal axis location of the cursor. Third period 505 is a horizontal output period of the cursor data. Fourth period 506 is a vertical output period of the cursor data.

As described above in detail, the present invention enhances processing speed by processing cursor data to be displayed on a monitor screen using hardware and therefore reduces the amount of software required. Further, the present invention provides a video adapter for use in a monitor and having rapid operation speed which precisely re-adjusts the cursor's location during blanking periods.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A cursor processor comprising:

reference location designation generator means for receiving an external cursor location data signal and cursor display control and write control signals to generate first and second X-axis reference location data signals and Y-axis location data signals and cursor display driving data signals for designating a location where a cursor is displayed;

pixel location data generator means for generating location data signals of a currently-displayed pixel, said pixel location data generator means comprising a first counter for counting a blanking sign to generate a Y-axis pixel location data signal and a second counter for counting a video pulse to generate an X-axis pixel location data signal;

location control signal generator means for generating location active section signals of x and Y axes to set a cursor display region according to the reference location data and the pixel location data, said location control signal generator means comprising a first comparator for comparing the X-axis reference location data signal from said reference location designation generator means with the X-axis pixel location data signal from said pixel location data generator means to generate a pulse which indicates the start position of the cursor with respect to a vertical axis, a second comparator for comparing the Y-axis reference location data signal from said reference location designation generator means with the Y-axis pixel location data signal from said pixel location data generator means to generate a pulse which indicates the start position of the cursor with respect to a horizontal axis, first pulse width regulating means for regulating the width of pulses from said first comparator to generate a Y-axis active section signal, and second pulse width regulating means for regulating the width of pulses from said second comparator to generate an X-axis active section signal;

cursor data generator means for generating cursor data signals according to the Y-axis location active section signal;

cursor data array means for re-arranging cursor data signals into cursor shape data signals and cursor pattern data signals and bit-shifting the cursor shape and cursor pattern data signals according to the value of the first X-axis reference location data signal generated from said reference location designation generator means; and data mixer means for mixing said re-arranged cursor data with video data.

2. A cursor processor as claimed in claim 1, wherein said reference location designation generator means comprises:

logic control means for logically operating the cursor location data signal, the cursor display control signals and the write control signals to determine whether an input address is an X-axis or Y-axis address;

a first register for receiving the output of said logic control means and the cursor location data signals to generate Y-axis reference location data signals and cursor display driving data signals; and a second register for receiving the output of said logic control means and the cursor location data to generate X-axis reference location data signals.

3. A cursor processor as claimed in claim 2, wherein said logic control means comprises:

a NOR gate for NOR-operating said cursor display control signal and said write control signal and generating an output signal;

a first AND gate for AND-operating a first portion of the cursor location data signal with the output signal from said NOR gate; and a second AND gate for AND-operating a second portion of the cursor location data signal with the output signal from said NOR gate.

4. A cursor processor as claimed in claim 1, wherein said first counter is initialized by a vertical sync signal and said second counter is initialized by the blanking signal.

5. A cursor processor as claimed in claim 1, wherein said cursor data generator means comprises:

a NOR gate for NOR-operating the Y-axis active section signal from said location control signal generator means and a blanking signal;

a flipflop for inverting the status of output signal by the signal from NOR-gate and the signal applied to its clear port;

clock pulse dividing means for dividing the video clock pulse train by two according to output pulse from said flipflop;

first address generating means for counting up the divided video clock train to generate a memory read signal and lower-order two-bit address signal; and second address generating means for counting up the blanking signal to generate a higher-order five-bit address signal while said Y-axis active section signal is applied from said location control signal generator means.

6. A cursor processor as claimed in claim 1, wherein said cursor data array means performs the array operation of cursor data only while high-logic cursor display driving data is applied from said reference location data generator means.

7. A cursor processor as claimed in claim 1, wherein said data mixer means comprises:

a first OR gate group for OR-operating cursor pattern data signal from said cursor data array means and eight higher-order bits of 16-bit video data;

a second OR gate group for OR-operating the cursor shape data signal from said cursor data array means and eight lower-order bits of 16-bit video data;

a first XOR gate group for XOR-operating the output of said first OR gate group and the cursor shape data signal from said cursor data array means;

a second XOR gate group for XOR-operating the output of said second OR gate group and the cursor shape data signal from said cursor data array means; and a plurality of registers for temporarily storing the outputs of said first and second XOR gate groups.

8. A cursor processor as claimed in claim 7, wherein said registers operate only during a horizontal scanning period by a blanking signal applied to their preset ports.

9. A cursor processor as claimed in claim 8, wherein said registers transmit the XOR-operated result input from said first and second XOR gate groups whenever a video clock pulse is input to their clock ports.

* * * * *